US010675642B2

(12) United States Patent
Palle

(10) Patent No.: US 10,675,642 B2
(45) Date of Patent: Jun. 9, 2020

(54) LOW PRESSURE WATERMIST NOZZLE MANIFOLD

(75) Inventor: Carsten Palle, Zug (CH)

(73) Assignee: VID FIRE-KILL APS, Svendborg (DK)

( * ) Notice: Subject to any disclaimer, the term of this patent is extended or adjusted under 35 U.S.C. 154(b) by 4 days.

(21) Appl. No.: 13/819,653

(22) PCT Filed: Aug. 31, 2011

(86) PCT No.: PCT/DK2011/050330
§ 371 (c)(1),
(2), (4) Date: Jul. 10, 2013

(87) PCT Pub. No.: WO2012/031595
PCT Pub. Date: Mar. 15, 2012

(65) Prior Publication Data

US 2013/0292495 A1 Nov. 7, 2013

(30) Foreign Application Priority Data

Sep. 6, 2010 (DK) ..... 2010 00791

(51) Int. Cl.
*B05B 1/02* (2006.01)
*B05B 1/20* (2006.01)
(Continued)

(52) U.S. Cl.
CPC ..... *B05B 1/02* (2013.01); *A62C 31/05* (2013.01); *A62C 99/0072* (2013.01); *B05B 1/202* (2013.01); *B05B 1/3415* (2013.01)

(58) Field of Classification Search
CPC ..... B05B 1/02; B05B 1/202; B05B 1/3415; B05B 1/14; B05B 1/3421; A62C 31/05; A62C 99/0072
(Continued)

(56) References Cited

U.S. PATENT DOCUMENTS 4,736,801 A 4/1988 Grewell
5,433,383 A * 7/1995 Sundholm ..... 239/383
(Continued)

FOREIGN PATENT DOCUMENTS

CN 1137760 12/1996
CN 2707308 Y 7/2005
(Continued)

OTHER PUBLICATIONS

Water Mist Visualization and Droplet Size Analysis in Large-Scale Fire Suppression Research Anleitner, R.; Burchell, H.; Fleming, J. W.; Maranghides, A.; Montgomery, J.; Sheinson, R. S. Halon Options Technical Working Conference. Proceedings. HOTWC 2001. Apr. 24-26, 2001, 407-413 pp. 2001.*
(Continued)

*Primary Examiner* — Viet Le
*Assistant Examiner* — Juan C Barrera
(74) *Attorney, Agent, or Firm* — Michael Best & Friedrich LLP

(57) ABSTRACT

The invention is characterized by consisting of a body (1) with a central cavity (2) having an open inlet-port (3), and one or multiple cylindrical shaped cavities (**4*i*), which are connected to the central cavity via one or 5 more openings (5*i*) with cross section areas less that the cylindrical cavity (4*i*), and where there is one centrally located opening (6*i*) in the cylindrical cavity end surfaces opposite the openings (5*i*) into the central cavity (2**).

5 Claims, 2 Drawing Sheets

Figure 1:
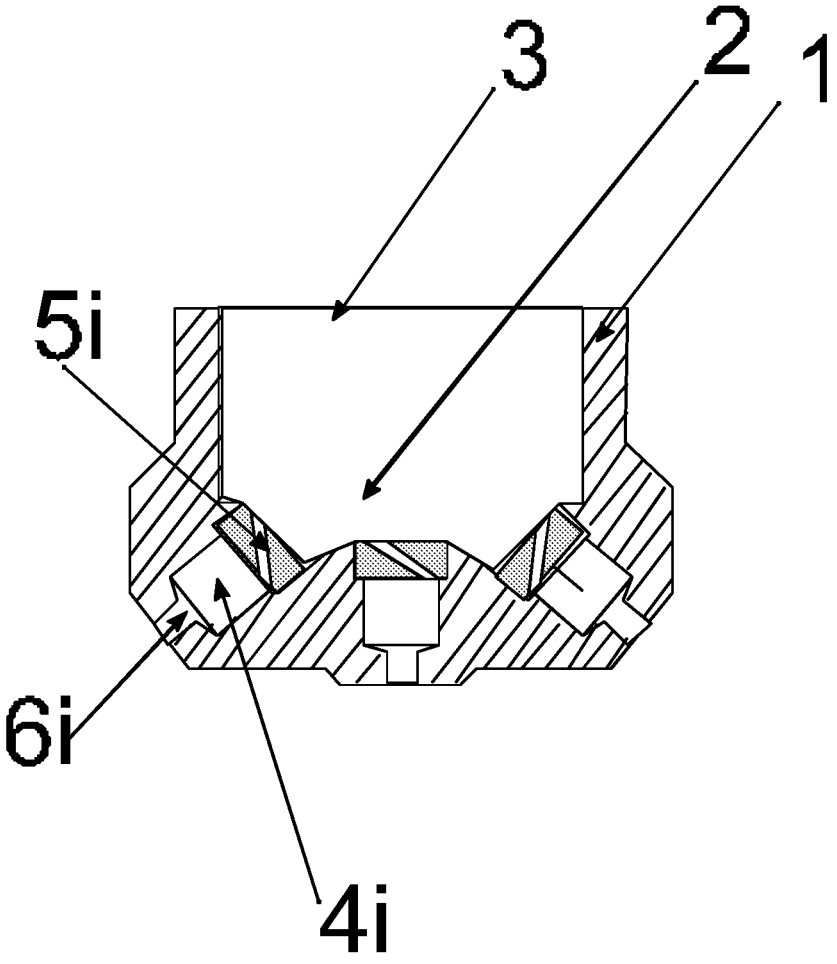

(51) Int. Cl.

| | |
|---|---|
| ***B05B 1/34*** | (2006.01) |
| ***A62C 31/05*** | (2006.01) |
| ***A62C 99/00*** | (2010.01) |

(58) Field of Classification Search
USPC ..... 239/594, 590, 590.3, 590.5, 592
See application file for complete search history.

(56) References Cited

U.S. PATENT DOCUMENTS

| | | | | |
|---|---|---|---|---|
| 5,685,376 | A | 11/1997 | Tirronen et al. | |
| 6,315,219 | B1 | 11/2001 | Palestrant | |
| 7,578,454 | B2 * | 8/2009 | Joo | 239/488 |
| 2006/0086831 | A1 * | 4/2006 | Tsai | A62C 31/05 239/553 |
| 2008/0083543 | A1 * | 4/2008 | Joo | A62C 31/05 169/16 |

FOREIGN PATENT DOCUMENTS

| | | | |
|---|---|---|---|
| CN | 2738834 | Y | 11/2005 |
| CN | 2887348 | Y | 4/2007 |
| CN | 101357255 | A | 2/2009 |
| DE | 200 04 206 | U1 | 7/2000 |
| DE | 20201091 | U1 | 8/2002 |
| WO | WO92/20454 | A1 | 11/1992 |
| WO | WO94/06517 | A1 | 3/1994 |
| WO | 2008/036298 | A2 | 3/2008 |

OTHER PUBLICATIONS

European Patent Office Action for Application No. 11752096.5 dated Aug. 7, 2017 (4 pages).

* cited by examiner

LOW PRESSURE WATERMIST NOZZLE MANIFOLD

CROSS-REFERENCE TO RELATED APPLICATIONS

This is the U.S. national stage entry of International Patent Application No. PCT/DK2011/050330, filed on Aug. 31, 2011, which claims priority to Danish Patent Application No. PA 2010 00791, filed on Sept. 6, 2010, the contents of all of which are herein fully incorporated by reference.

An arrangement of nozzles for fire protection with spray of water droplets with droplet diameters less than 1 mm which are characterized by consisting of a body having a central cavity with one opening to free, and multiple openings with openings to cavities having one opening in the wall opposite the openings to the central cavity.

The invention concerns a nozzle arrangement for low water pressures to provide active fire fighting with spray of mist consisting of water droplets with diameters less than 0.001 millimeters.

Low pressure water mist nozzles for fire fighting is a known technology.

A problem in supplying water nozzles with water pressures in the range of 1 bar to 20 bars, has been the low energy in the water supply, which are to low both to break up the water supply into a spray of water droplets with droplet diameters of less than 0.0035 meters, and simultaneously also providing a high flux homogeneous water droplet spray, in reasonable large areas over relative large distances.

A known method to make water droplet spray nozzles is known from fire sprinklers, where a water jet is hitting a deflector plate, which splits up the water jet into a spray of droplets.

A problem with the fire sprinkler spray is that the water is distributed in fairly large droplet sizes causing fire sprinklers to require fairly large water supplies.

A known method to reduce the high water supply requirement of fire sprinklers has been to reduce the orifice diameter of the water jet nozzle to form water jet having smaller diameters, and thereby requiring a reduced water supply.

A disadvantage of reducing the water jet diameter has been reductions in water coverage areas and that water densities become uneven and in sufficient for fighting fires effectively.

An other disadvantage is that the deflector makes the nozzle sensitive to physical impacts and abuse.

The disadvantages has tried to be reduced by designing nozzles with a small diameter orifice to deliver a small diameter water jet, which hit a deflector surface, flat or spherical, which are smaller than the water jet diameter. Here the deflected water collides with the water in the water jet, and the kinetic energy in of the water jet breaks up the water in small water droplets.

Another known method to produce sprays of water droplets having small diameters is to design nozzles to have two or multiple water jets with small diameters colliding in free space, to use the kinetic energy to split up the water jets into a spray of water droplets having small droplet diameters.

A third known method to produce a spray of small water droplets from low pressure water supplies is the press the water out of a narrow slot, forming a thin water film, which collapses into a spray of small water droplets.

A forth known method to produce a spray of small water droplets from a low pressure water supply is to exit a rotating water jet from a nozzle opening. Here the centrifuge force breaks the water jet up into small droplet.

Problems with the above solution are that the water spray nozzles have very little coverage areas, and that the water mist sprays have very large water droplet size variations, and that the nozzles are not able to deliver homogeneous water droplet distributions in larger coverage areas to effectively fight fires with a homogenious spray with a high flux spray of water droplets with diameters less than 0.00035 meters, to effectively fight fires from fixed installed system.

A known method to solve the above problems is to apply more kinetic energy to help splitting the nozzle water supply into smaller droplets, typically water pressures 20 bars to 150 bars.

Disadvantages in supplying water at high water pressures are that the water pump and water pipe system shall be designed for high internal pressures, and that the pumps require large power supplies. Also nozzle must have small orifices not to supply large water quantities at high water pressures. This makes the nozzles more sensitive to clogging, and the whole fire fighting systems more technical complicated and cost expensive.

The described invention solves the mentioned problems and disadvantages.

The invention is characterized by consisting of a body (1) with a central cavity (2) having an open inlet-port (3), and one or multiple cylindrical shaped cavities (4*i*), which are connected to the central cavity via one or more openings (5*i*) with cross section areas less that the cylindrical cavity (4*i*), and where there is one centrally located opening (6*i*) in the cylindrical cavity end surfaces opposite the openings (5*i*) into the central cavity (2). As shown in FIG. 1, the one or more openings (5*i*) are formed through a separating element arranged between the central cavity (2) and each of the one or multiple cylindrically shaped cavities (4*i*).

The invention functions by, water from water supply flows through the inlet port (3) into the central cavity (2), and from the central cavity water flows through the openings (5*i*) into the cylindrical cavities (4*i*) and from here out through the openings (6*i*) from where the water is distributed in a homogeniously spray of small water droplets which are designed to cover the volume on fire.

A variation of the invention is characterized by one or multiple cylindrical cavities (4*i*) having one or more openings (5*i*) to the central cavity (2) with internal surface angles which are not in parallel with the central line of the cylindrical cavity, and where one or more central located openings (6*i*) are located in the central line of one or more cylindrical cavities (4*i*)

The variation functions with that water flows from the central cavity (2) through one or multiple openings (5*i*) in the into the cylindrical cavities (4*i*). Water from openings (5*i*) which are not in parallel with the centrelines of the cylindrical cavity, makes the water spin around in the cylindric cavities (4*i*). When the water exit the cylindrical cavities through the centrally located opening (6*i*) the water is thrown to the sides away from the centreline of the water jet, splitting the water jet in to a spray of small water droplets.

A variation of the invention is characterized by having the cylindrical cavities (4*i*) and the central openings (6*i*) located around the central cavity (2).

The variation performs with the invention delivering a spherical water mist spray.

A variation of the above variation is characterised by having additional one or more cylindrical cavities (4*i*) with central openings (6*i*) located to deliver one or more down wards sprays.

Another variation of the invention is characterised by the central cavity being a cylindrical cavity with a length longer than 2×the cavity diameter.

FIG. 1: Shows an example on the invention having cylindrical cavities and central openings located around the central cavity, and a central down ward positioned cylindrical cavity with a central opening.

The figure also shows an example where openings between the central cavity and the cylindrical cavities not having surfaces which are in parallel with the cylindrical cavity centre lines.

Figure 2:
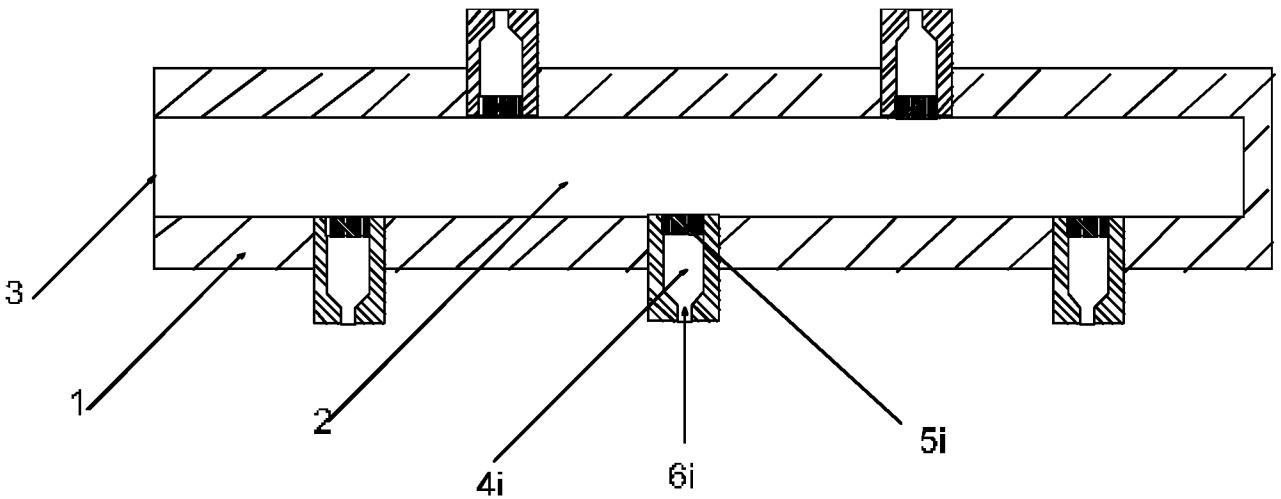

FIG. 2: Show an example on the invention where the central cavity has the shape of a cylinder where the cylinder length is more than 2×the cylinder diameter.

The invention claimed is:

1. A nozzle for fire protection with water droplets having droplet sizes diameters less than 1 mm, the nozzle comprising:

a body with a central cavity having an open inlet port and one or multiple cylindrical cavities, a plurality of separating elements, each positioned at an interface between the central cavity and a corresponding one of the one or multiple cylindrical cavities;

wherein one or more elongate openings each extend between the central cavity and a corresponding one of the one or multiple cylindrical cavities, wherein each of the one or more elongate openings open directly to the central cavity, and wherein each elongate opening of the one or more elongate openings are completely defined inside a corresponding one of the separating elements;

wherein said one or multiple cylindrical cavities each have a first end and a cylindrical cavity end surface opposite the openings, and wherein each of the one or more elongate openings include cross section areas less than that of the corresponding one of the one or multiple cylindrical cavities, wherein each of the one or more elongate openings open into said first end, and wherein there is one centrally located opening in each cylindrical cavity end surface opposite the one or more elongate openings into the central cavity; wherein the one or more elongate openings have internal surface angles which extend in a direction not parallel with and not perpendicular to a longitudinal axis of the corresponding cylindrical cavity thereby causing water to contact a surface of the corresponding cylindrical cavity so as to cause the water to spin around in the corresponding cylindrical cavity.

2. The nozzle according to claim 1 where the central cavity is characterized by having the shape of a cylinder where a cylinder length is more than two times a cylinder diameter.

3. The nozzle according to claim 1 where the centrally located opening is characterized by having a common centreline with the corresponding cylindrical cavity.

4. A nozzle according to claim 1, wherein said separating element has a thickness in the direction defined by the longitudinal axis of the corresponding cylindrical cavity, and wherein said thickness is smaller than a width of said separating element.

5. A low pressure water nozzle for fire protection with water droplets having droplet size diameters less than 1 mm, the nozzle comprising:

a body with a central cavity and an inlet port open to the central cavity, wherein the inlet port is configured to be connected to a water source having a water pressure between 1 bar and 20 bars;

a plurality of cylindrical cavities, wherein each cylindrical cavity includes a first end and a cylindrical cavity end surface opposite the first end, and wherein each cylindrical cavity defines a longitudinal axis therethrough;

a plurality of separating elements, each arranged between the central cavity and a corresponding one of the plurality of cylindrical cavities, wherein each separating element completely defines an elongated opening extending internally therethrough, wherein each elongated opening has a first end directly open to the central cavity and a second end open to the corresponding cylindrical cavity, and wherein the each elongated opening has an internal surface angle that is oblique to the longitudinal axis of the corresponding cylindrical cavity.

* * * * *